United States Patent [19]

Schlunke et al.

[11] Patent Number: 4,753,213

[45] Date of Patent: Jun. 28, 1988

[54] INJECTION OF FUEL TO AN ENGINE

[75] Inventors: Christopher K. Schlunke, Kingsley; Peter W. Ragg, Mount Lawley; Robert M. Davis, Marylands; Philip C. Lucas, Padbury, all of Australia

[73] Assignee: Orbital Engine Company Proprietary Limited, Balcatta, Australia

[21] Appl. No.: 900,131

[22] Filed: Aug. 25, 1986

[30] Foreign Application Priority Data

Aug. 1, 1986 [AU] Australia ..... PH07228

[51] Int. Cl.[4] ..... F02M 67/02

[52] U.S. Cl. ..... 123/533; 123/73 C; 123/305; 239/460; 239/533.12

[58] Field of Search ..... 123/73 C, 531, 292, 123/532, 257, 533, 305, 534, 535; 239/95, 453, 460, 474, 533.12, 585

[56] References Cited

U.S. PATENT DOCUMENTS

| | | | |
|---|---|---|---|
| 2,183,284 | 12/1939 | Wiebicke | 239/460 |
| 2,914,257 | 11/1959 | Wiant | 239/460 X |
| 3,838,821 | 10/1974 | Berlyn | 239/460 X |
| 4,006,719 | 2/1977 | Kanda et al. | 123/531 X |
| 4,372,264 | 2/1983 | Trucco | 123/292 X |
| 4,394,963 | 7/1983 | Iwata | 123/531 X |
| 4,413,780 | 11/1983 | Skinner et al. | 239/533.12 X |

*Primary Examiner*—Willis R. Wolfe, Jr.

*Attorney, Agent, or Firm*—Murray and Whisenhunt

[57] ABSTRACT

A method and apparatus for injecting fuel into a combustion chamber of an internal combustion engine particularly of two stroke cycle spark ignited engine, wherein a metered quantity of fuel is entrained in a gas, and the fuel and gas mixture so formed is delivered through a nozzle into the combustion chamber under conditions that will establish a fuel spray having a dispersion velocity in the direction of the spray axis of not more than 25 meters/sec at 35 millimeters of spray penetration from the nozzle when measured in still air atmospheric pressure, and preferably that dispersion velocity is not more than 18 meters/sec at 70 millimeters from the nozzle.

26 Claims, 7 Drawing Sheets

INJECTION OF FUEL TO AN ENGINE

This invention relates to a method of injecting fuel and particularly a fuel-air mixture, into the combustion chamber of an internal combustion engine through a nozzle.

The characteristics of the spray of the fuel droplets issuing from a nozzle into a combustion chamber have major effects on the efficiency of the burning of the fuel, which in turn effects the stability of the operation of the engine, the fuel efficiency, and the exhaust emissions. To optimise these effects the desirable characteristics of the spray pattern of the fuel issuing from the nozzle include small fuel droplet size, controlled penetration of the fuel spray into the combustion chamber, and at least at low engine loads a relatively contained evenly distributed cloud of fuel droplets.

In the control of the harmful components of the engine exhaust it is desirable to control the placement of the fuel within the gas charge in the combustion chamber to meet a number of different parameters. Ideally the fuel should be distributed in the gas charge so that the resultant fuel-air mixture is readily ignitable at the spark plug, all the fuel has access to sufficient air to burn completely, and the flame is at a sufficient temperature to extend to all the fuel before being extinguished. There are other factors that must also be considered, such as combustion temperatures that may promote detonation, or the formation of undesirable contaminants in the exhaust gas.

It is the object of the present invention to provide a method of injecting fuel, through anozzle into an engine combustion chamber, which will contribute to the efficient combustion of the fuel and the control of emissions in engine exhaust gases.

With this object in view there is provided a method of injecting fuel into a combustion chamber of an internal combustion engine comprising delivering a metered quantity of fuel, preferably entrained in a gas, through a nozzle into the combustion chamber under conditions that would establish a fuel spray having a dispersion velocity in the direction of the spray axis of not more than 25 meters/sec at 35 millimeters of spray penetration from the nozzle when measured in still air under atmospheric pressure. Preferably the spray dispersion velocity is less than 18 meters/sec in the direction of the axis of the spray at 70 mm of spray penetration, from the nozzle.

It will be appreciated that for a number of reasons it is not convenient to provide a measure of spray penetration within the combustion chamber under operating conditions. Accordingly, in defining the present invention the spray velocities and penetrations are measured in still air under atmospheric pressure. These measurements are made with the nozzle and the injector mechanism that is used to deliver the fuel to the combustion chamber, and is operated under the same conditions as when injecting fuel into the combustion chamber of an engine, that is the fuel and gas pressures are the same and the nozzle opening movement is the same, as under normal engine operation.

Preferably, the spray dispersion velocity in the axial direction is below 16 meters/sec at 35 mm, and usually between 6 to 10 metres/sec, preferably about 8 meters/-sec. The spray dispersion velocity in the radial direction, that is normal to the axis of the spray, preferably is not more than 20 meters/sec and usually less than 10 meters/sec at 35 mm from the axis of the spray.

The maintaining of the above spray penetration parameters is of particular importance at low fueling rates, that is at low engine loads, in controlling hydrocarbons (HC) in the engine exhaust gas. At low loads the quantity of fuel injected per cycle is low and if dispersed widely throughout the gas charge will result in poor ignitability and flame maintenance. To avoid or reduce these adverse effects it is necessary to generally limit the distribution of the fuel in the gas charge, and particularly to establish a rich mixture in the immediate vicinity of the ignition point (spark plug).

In this way the charge is readily ignitable due to the rich mixture at the spark plug. The relatively small quantity of fuel is not dispersed thinly through the complete gas charge, nor is the fuel distributed into highly quenched areas of the gas charge, both of which would contribute to low penetration of the flame and resultant unburnt fuel to create HC in the exhaust.

Although the limited penetration can, without other corrective action, result in some increase in HC emissions at the upper end of the engine load range, this is in an area of operation experienced for only a relative small proportion of the total engine operating time in many applications such as automotive.

The benefits of the low penetration fuel spray are particularly relevant in the engine operation up to 80 percent of maximum engine load and up to 50 percent of engine maximum operational speed.

The use of the low penetration fuel spray is particularly advantageous when the injection nozzle is of a construction that produces a fuel spray pattern forming a cloud having fuel dispersed therethroughout rather than a pattern of the hollow conical type. There is disclosed in our co-pending U.S. patent application Ser. No. 040,778, filed Mar. 11, 1987 still pending a particular method of injecting fuel into a combustion chamber, and a particular form of nozzle, each of which may be employed with the low penetration fuel spray disclosed herein. The disclosures in said co-pending application are hereby incorporated in this specification by reference.

Accordingly, in one preferred arrangement the method of injecting fuel into the combustion chamber comprises entraining fuel in a gas stream and selectively opening a nozzle to discharge the fuel-gas mixture so formed into the combustion chamber, and promoting preferred respective paths for the fuel-gas mixture as it passes through the nozzle to produce a generally circular shaped first array of gas entrained fuel droplets and a second array of gas entrained fuel droplets within the area defined by the first array issuing from the nozzle, the fuel droplets issuing from the nozzle having a dispersion velocity in the direction of the spray axis of not more than 25 meters/sec at 35 millimeters of spray penetration, when measured as described.

In the above discussed preferred arrangement of the invention the arrays of gas entrained fuel droplets provide greater exposure of the fuel droplets to the air, and as the streams from said paths move away from the nozzle, and decelerate, the streams break-up so the fuel droplets disperse and form a mist. The dispersed streams finally form a common cloud of fuel droplets.

When the array is such that the streams of fuel droplets are in a circular or divergent conical formation, a toroidal air flow is created within the formation generally concentric therewith. The air flow in the outer region of the toroid compliments that of the streams of fuel droplets, and fuel becomes entrained in the toroidal air flow to be carried inward of the stream formation. This dispersion of the fuel droplets contributes to the effective distribution of the fuel while retaining the fuel within a defined area.

The spray cloud is preferably contained within a conical volume defined by an included angle of not less than about 90° and up to about 210°.

The fuel entrained in the air may be delivered into the combustion chamber through a poppet valve controlled port, the valve being provided with a plurality of notches spaced around the periphery of the terminal edge portion. The provision of these notches provides two alternative paths for the fuel-gas mixture, an outer path formed by the un-notched portions of the terminal edge of the valve element, and the other path through the notches the bottom edge of which are displaced radially inward from the terminal edge of the valve element.

The surface of the valve over which the fuel-gas mixtures passes when the valve is open is preferably of a divergent conical form so that the fuel-gas mixture issuing from the terminal edge will initially maintain this direction of flow to form an outer array of gas entrained fuel droplets. However, where the terminal edge is interrupted by the notches at least some of the fuel and gas will pass through the notch and so issue from the valve inwardly of the terminal edge thereof.

The above discussed construction of the poppet valve forms a cloud of fuel and gas intimately mixed and is consequently a highly ignitable mixture, with a low penetration into the gas charge in the combustion chamber. This cloud can be located in the combustion chamber in close proximity to the spark plug by suitable relative location of the injection nozzle and spark plug. The particle size of the fuel in the cloud is preferably of the order of up to 10 microns (Sauter Mean Diameter).

This invention will be more readily understood from the following description with reference to the accompanying drawing.

Figure 1:
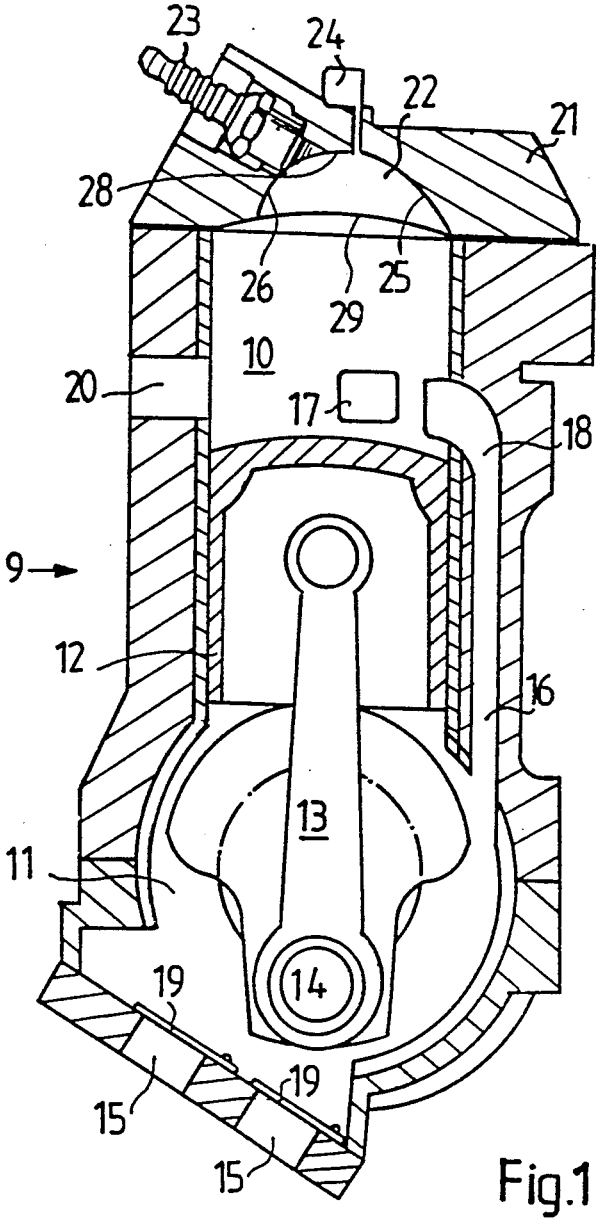
FIG. 1 is a sectional view in simplified form of one cylinder of a two stroke reciprocating engine in which the invention may be used.

Referring now to FIG. 1 the engine 9 is a single cylinder two-stroke cycle gasoline engine, of generally conventional construction, having a cylinder 10, crankcase 11 and piston 12 that reciprocates in the cylinder 10. The piston 12 is coupled by the connecting rod 13 to the crankshaft 14. The crankcase is provided with air induction ports 15, incorporating conventional reed valves 19 and three transfer passages 16 (only one shown) communicate the crankcase with respective transfer ports, two of which are shown at 17 and 18, the third being the equivalent to 17 on the opposite side of port 18. An exhaust port 20 is formed in the wall of the cylinder generally opposite the central transfer port 18.

The detachable cylinder head 21 has a combustion cavity 22 into which the spark plug 23 and fuel injector 24 project. The cavity 22 is located substantially symmetrically with respect to the axial plane of the cylinder extending through the centre of the transfer port 18 and exhaust port 20. The cavity 22 extends across the cylinder from the cylinder wall immediately above the transfer port 18 to a distance past the cylinder centre line.

The cross sectional shape of the cavity 22 along the above referred to axial plane of the cylinder is substantially arcuate at the deepest point or base 28, with the centre line of the arc somewhat closer to the centre line of the cylinder than to the cylinder wall above the transfer port 18. The end of the arcuate base 28 closer to the cylinder wall above the transfer port 18, merges with a generally straight face 25 and the opposite or inner end of the arcuate base 28 merges with a relatively short steep face 26.

The injector 24 is located so the nozzle thereof is at about the deepest part of the cavity 22, while the spark plug 23, is located in the face of the cavity remote from the transfer port 18. Accordingly, the air charge entering the cylinder through the transfer port will pass along the cavity past the injector nozzle 24 toward the spark plug and so carries the fuel from the nozzle to the spark plug.

Further details of the form of the cavity 22 and of the combustion process derived therefrom are disclosed in U.S. patent application Ser. No. 866,527 lodged on the May 23, 1986 entitled "Improvements Relating to Two Stroke Cycle Internal Combustion Engines", by Schlunke and Ragg, now U.S. Pat. No. 4,683,393, being hereby incorporated herein by reference.

Figure 2:
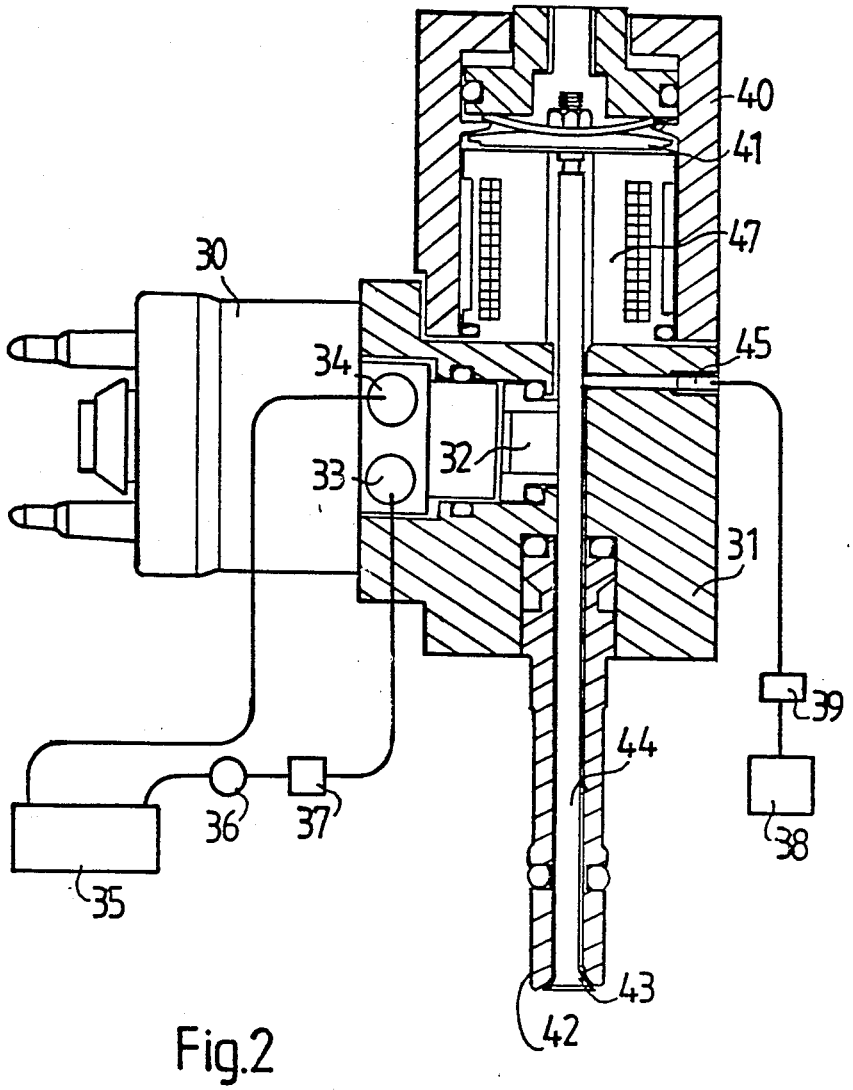
FIG. 2 is a sectional view of fuel injector that may be used in the performance of the invention.

The injector 24 is an integral part of a fuel metering and injection system whereby fuel entrained in air is delivered to the combustion chamber of the engine by the pressure of the air supply. One particular form of fuel metering and injection unit is illustrated in FIG. 2 of the drawings.

The fuel metering and injection unit incorporates a suitably available metering device 30, such as an automotive type throttle body injector, coupled to an injector body 31 having a holding chamber 32 therein. Fuel is drawn from the fuel reservoir 35 delivered by the fuel pump 36 via the pressure regulator 37 through fuel inlet port 33 to the metering device 30. The metering device operating in a known manner meters an amount of fuel into the holding chamber 32 in accordance with the engine fuel demand. Excess fuel supplied to the metering device is returned to the fuel reservoir 35 via the fuel return port 34. The particular construction of the fuel metering device 30 is not critical to the present invention and any suitable device may be used.

In operation, the holding chamber 32 is pressurised by air supplied from the air source 38 via pressure regulator 39 through air inlet port 45 in the body 31. Injection valve 43 is actuated to permit the pressurised air to discharge the metered amount of fuel through injector tip 42 into a combustion chamber of the engine. Injection valve 43 is of the poppet valve construction opening inwardly to the combustion chamber, that is, outwradly from the holding chamber.

The injection valve 43 is coupled, via a valve stem 44, which passes through the holding chamber 32, to the armature 41 of solenoid 47 located within the injector body 31. The valve 43 is biased to the closed position by the disc spring 40, and is opened by energising the solenoid 47. Energising of the solenoid 47 is controlled in timed relation to the engine cycle to effect delivery of the fuel from the holding chamber 32 to the engine combustion chamber.

Further details of the operation of the fuel injection system incorporating a holding chamber are disclosed in U.S. patent application Ser. No. 740,067 filed 2nd Apr. 1985 now U.S. Pat. No. 4,693,224, and No. 849,501 filed Mar. 26, 1986 by M. McKay, still pending, the disclosures of which are incorporated herein by reference.

Figure 3:
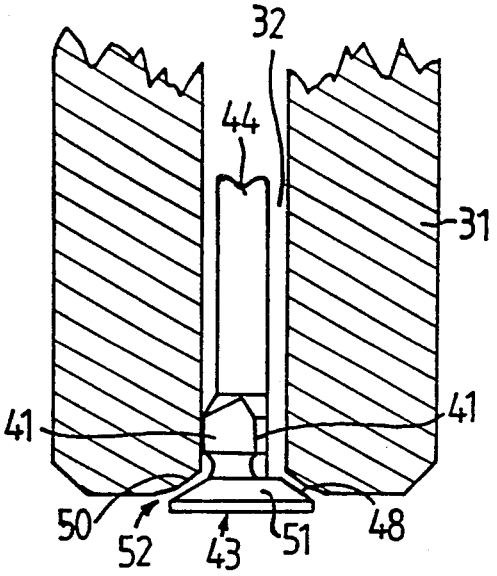
FIG. 3 is an enlarged sectional view of the nozzle portion of the injector shown in FIG. 2.

FIG. 3 shows the above described injection valve 43 and the adjacent portion of the injector body 31. Valve 43 is affixed to valve stem 44 which is in turn actuated by the solenoid 47 as shown in Figure 2. Radial movement of valve is controlled by the bearing of the three peripheral surfaces 41 on the wall of the holding chamber 32. Mating sealing faces 50 and 51 are provided on the valve 43 and in the port 48. These faces have an included angle of 120°. When valve 43 is actuated, faces 50 and 51 separate leaving throat 52 therebetween through which the fuel and compressed gas are released into the combustion chamber.

The design of the nozzle will influence the degree of penetration of the fuel into the combustion chamber. One particular design of valve element for use in the metering and injection unit above described is illustrated in FIGS. 4 and 5.

Figure 4:
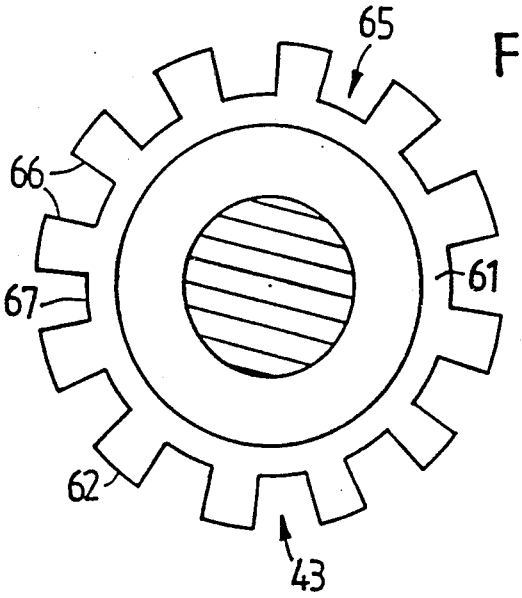
FIG. 4 shows an enlarged view of a preferred form of the head of the valve element.
Figure 5:
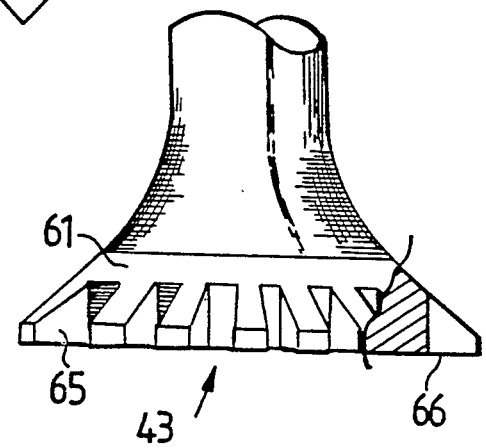
FIG. 5 shows a part-sectional elevation of the valve element of FIG. 4.

As is seen from FIG. 4 and 5 there are twelve equally spaced notches or slots 65 about the periphery of the poppet valve, and an annular sealing face 61 which in use co-operates with a corresponding sealing face on the nozzle port as previously described. The included angle of the sealing face 61 is normally 120° but may be at any other appropriate angle such as, for example, the sometimes used 90° angle.

In the embodiment shown in FIG. 4 there are twelve notches equally spaced around the perimeter of the poppet head with an included angle between the opposite radial walls of each notch of 14.5°. In the specific valve shown, the overall diameter of the valve head is 4.9 mm with the width of the notch between the opposite sides 66 thereof at the periphery 0.7 mm and the minimum depth on the centre line of the notch of 0.7 mm.

The base 67 of the notch may be of a configuration other than parallel to the axis of the valve and typically may be inclined inwardly and downwardly towards the axis of the valve as shown, so that the depth of the notch at the lower face of the valve is greater than at the upper face. Typically the angle of the inclined base to the axis of the valve may be of the order of 30°. In other variations the plane of the base of the notch may be parallel to the valve axis or curved in either direction, that is so that the depth of the slot increases from the top to the bottom edge or vice versa.

With a valve head of the above construction the fuel and air mixture issues from the valve to establish a cloud of fuel droplets some distance below the valve head.

Figure 6:
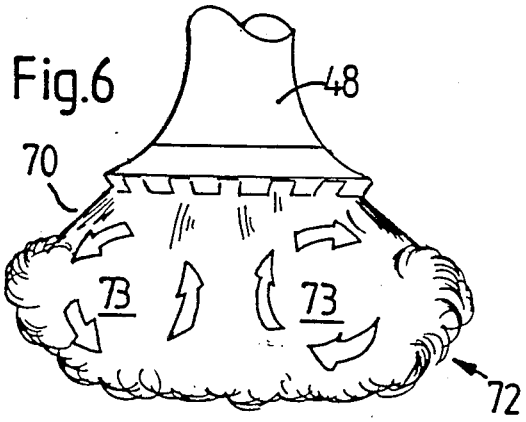
FIG. 6 is an illustration of the cloud formation of the fuel spray achieved with the valve head shown in FIGS. 4 and 5.

Referring now to FIG. 6, the boundary streams 70 of fuel and gas issuing from the un-notched portion of the valve may be somewhat richer in fuel than the inner streams.

As previously discussed the streams move some distance from the valve and decelerate, the streams break up into a fuel mist, this mist is carried inwardly from the boundary streams 70 to form within the general confine of the array of streams a generally continuous cloud 72 of fine droplets of fuel dispersed within a body of air.

It will be noted that the main streams 70 issue from the edge of the valve on a divergent path in the form of a conical curtain, and as a result of the pressure gradient so produced develop a generally toroidal air flow 73 within the volume bounded by the fuel-air streams 70. The parts of the toroidal flow adjacent the streams 70 are in the same direction thereas. Thus the outermost portion of this toroidal air flow takes fuel droplets from the boundary streams 70 and carries them inwardly to be dispersed within the air moving in the circular flow, which assists distribution and limits penetration of the fuel from the injector nozzle. Thus the effect of this toroidal air flow 73 is to generally prevent outward and downward dispersion of the fuel droplets which would cause a relatively dispersed cloud of fuel drops, and to carry the fuel drops towards the centre so that a concentrated fuel cloud is established.

Figure 7:
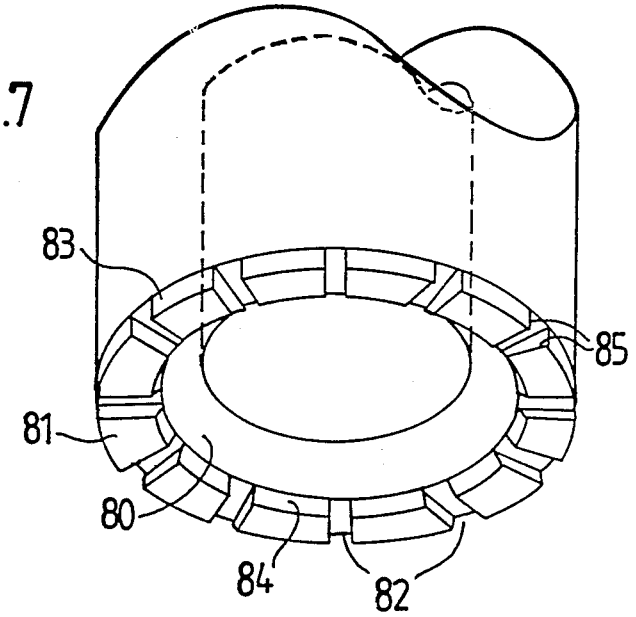
FIG. 7 is a perspective view of a valve port suitable for use with a conventional poppet valve in the practice of the present invention.

Beneficial effects on the control of the fuel spray penetration may also be achieved with a series of notches in the port with a conventional poppet valve without notches to open and close the port. A typical configuration of a notched port is shown in FIG. 7.

The port has an annular sealing face 80 which in use co-operates with a corresponding sealing face on a poppet valve. Downstream of the sealing face 80 is an annular end face 81 generally normal to the port axis, and an interconnecting generally cylindrical internal face 84. Twelve equally spaced notches 82 are formed in the end face 81 extending from the internal face 84 to the external peripheral face 83. Preferably the opposite walls 85 of the notches are parallel. The base of the notches is preferably flat, and parallel to the end face 81. The depth of the notch is such that that part of the fuel-air charge travelling through the port towards the notch when the valve is open, will not impinge on the cylindrical surface 84 and will pass through the notch unimpeded. The part of the fuel-air charge that does impinge on the cylindrical surface 84 between the notches 82 is deflected to travel along that face.

The above described arrangement of notches in the port will divide the fuel-air mixture issuing from the port into the two arrays of fuel droplets, an outer array issuing through the notches 82 and an inner array issuing from the un-notched portions of the internal face 81. In this arrangement the outer array is divergent with respect to the axis of the port generally continuing in the direction of the sealing face 80 while the inner array is generally of a cylindrical form following the internal face 84.

The fuel cloud created by the notched port is also low penetrating as is the cloud resulting from a notched valve of the same angle, and so the resultant fuel cloud may be principally retained within a combustion cavity provided in the cylinder head such as the cavity 22 in FIG. 1. Also when using the above notched port configuration the two arrays of fuel droplets provide an increased exposure of the fuel to air to promote ignitability and combustibility.

Figure 8:
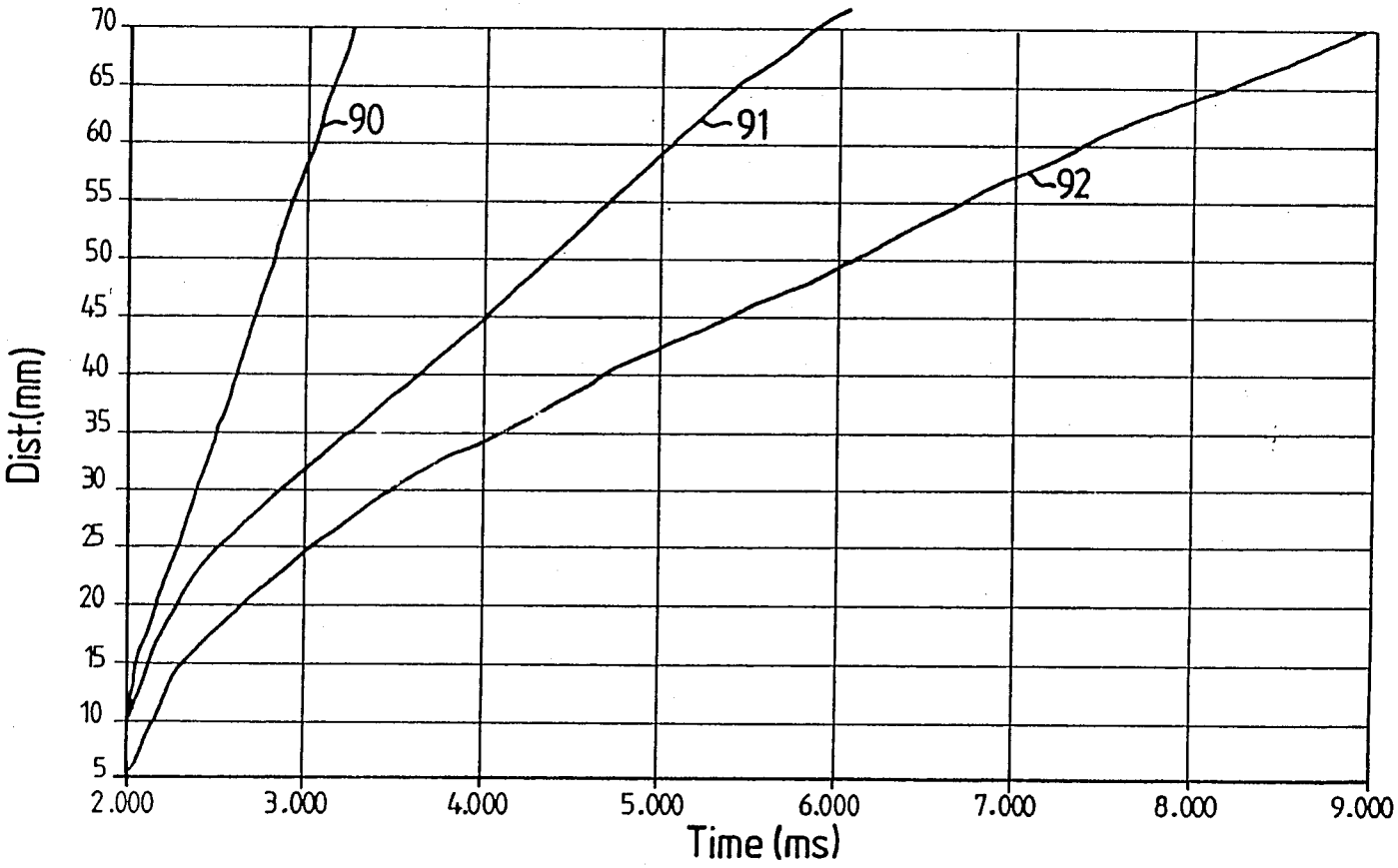
FIG. 8 illustrates the comparative penetration performance of the three different injector nozzles.

FIG. 8 is a series of distance-time graphs of the fuel spray from three different injector nozzles. The data used to establish these graphs was obtained by injecting kerosene from the respective nozzles in still air at atmosheric pressure. Kerosene was used as a substitute for petrol for safety reasons and the distances and velocities obtained with kerosene would not significantly differ from that of petrol. Each of the plots in FIG. 8 were obtained using a fuel metering and injection unit of the general construction as shown in FIG. 2 with an air supply at a pressure of 550 KPa an injector valve lift of 0.35 mm and a fuel mass in the range of 5.1 to 5.35 mg.

Plot 90 in FIG. 8 was obtained with an injector nozzle having a plain poppet type valve located in a recess in the tip of the nozzle, the recess providing a generally cylindrical wall surrounding the valve when the valve was in the open position. This construction produced a radially contained high penetration spray. The slope of the plot 90 represents the velocity of the spray which is of the order of 50 meters/sec at an axial distance of 25 mm from the nozle, and is still about 45 meters/sec at between 50 mm and 70 mm from the nozzle.

Plot 91 in FIG. 8 was obtained with an injector nozzle based on that used for plot 90 and modified to provide notches in the cylindrical wall surrounding the valve, generally of the form previously described with reference to FIG. 7 of the drawings. The nozzle provided spray velocities in the axial direction of about 20 metres/sec at 25 mm from the nozzle and about 12 meters/sec at between 50 to 70 mm from the nozzle.

Plot 92 in FIG. 8 was obtained using an injector nozzle of the general construction as described with reference to FIGS. 4 and 5 having a series of notches in the periphery of the valve. This construction provides the lowest extent of penetration of the three nozzles tested. At an axial distance of about 30 mm from the nozzle the spray velocity is about 12 meters/sec and at 50 to 60 mm from the nozzle the velocity is about 7 meters/sec.

Figure 9:
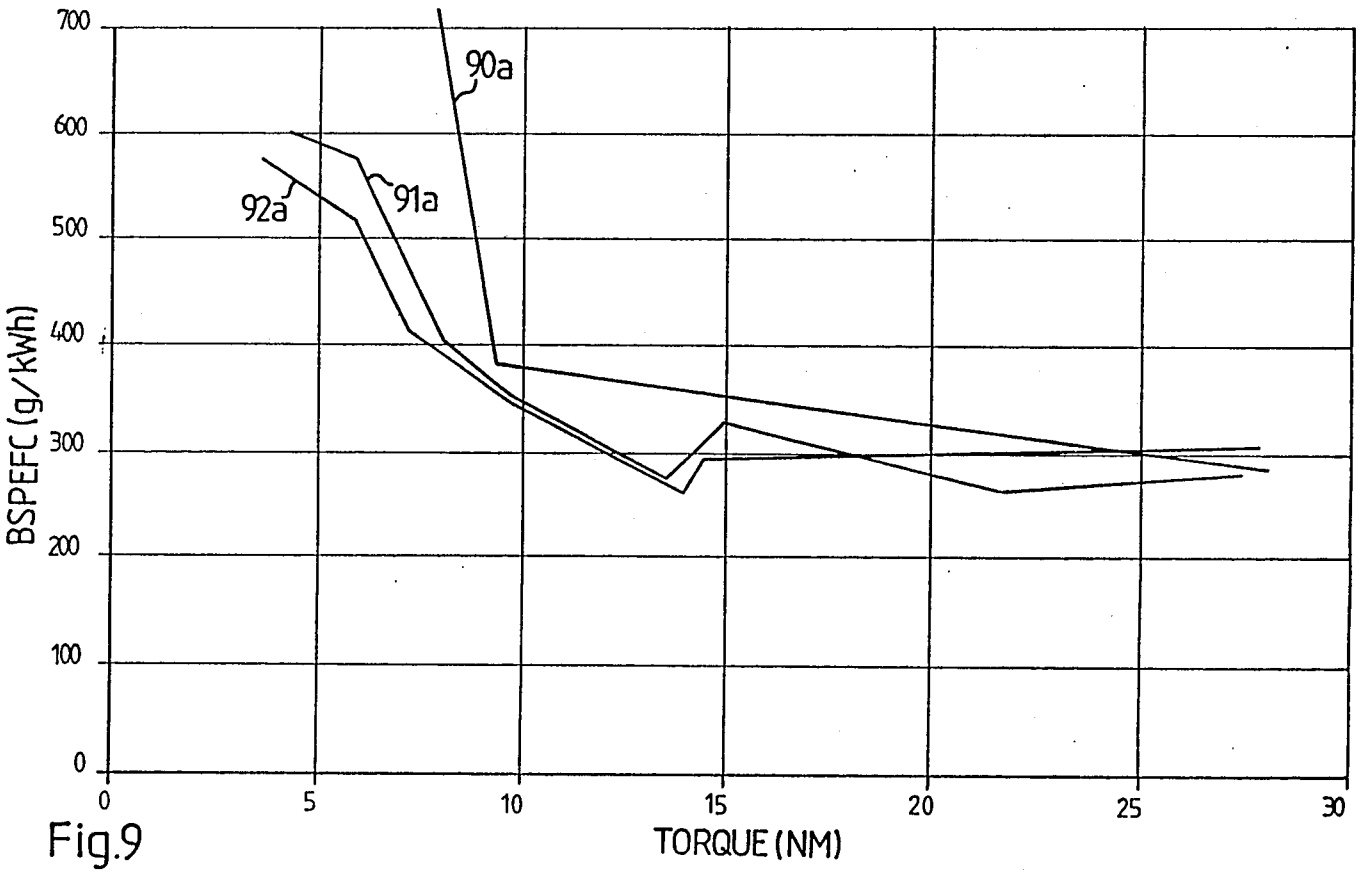
FIG. 9 illustrates the comparative fuel consumption of an engine with the same three injector nozzles as used in the tests represented in FIG. 8.

FIG. 9 is a further series of graphs showing the fuel consumption of the engine against torque for each of the same three injector nozzles as previously referred to in respect of FIG. 8. In this graph the plots are marked 90A, 91A and 92A and are thus the fuel consumption plots for the injector nozzles corresponding to plots 90, 91 and 92 respectively in FIG. 7. It will be noted from FIG. 9 that particularly in the low torque area substantial fuel consumption savings are made using the low penetration fuel sprays, as represented by plots 91 and 92 in FIG. 8.

Figure 10:
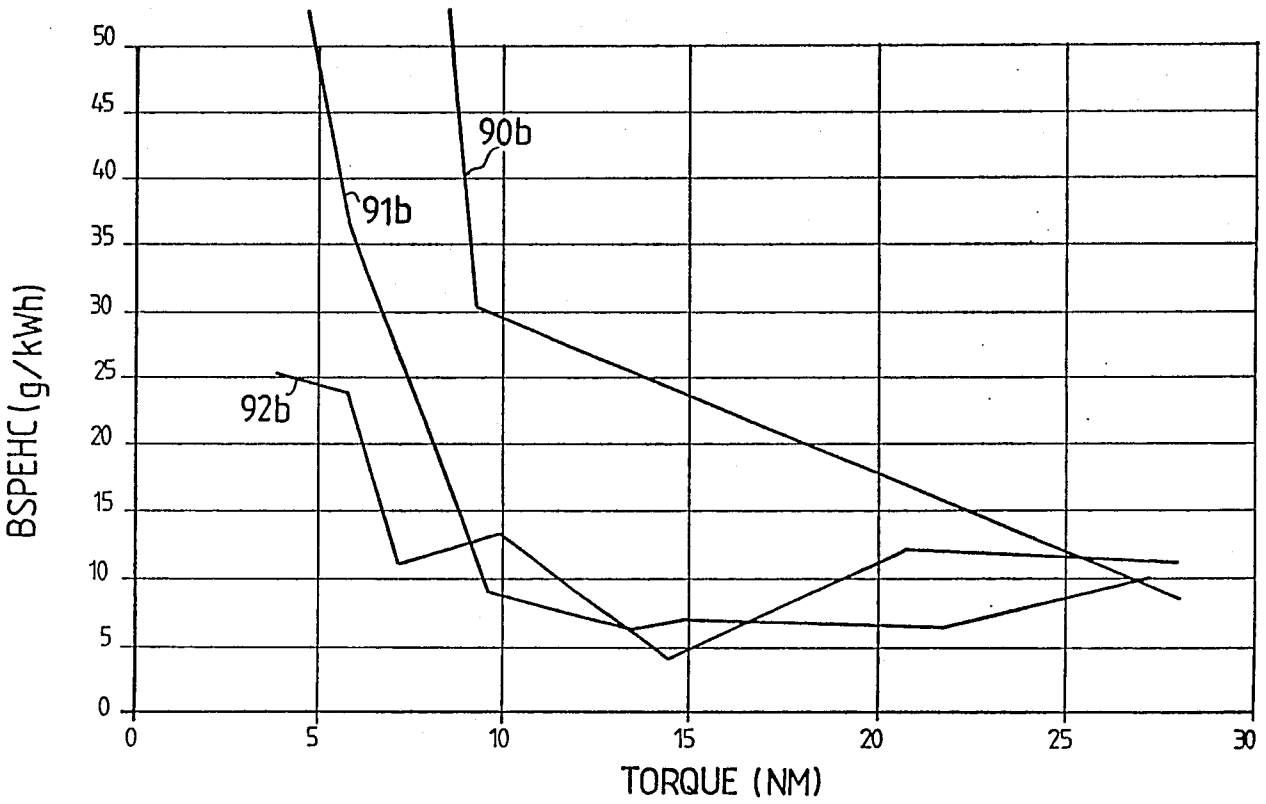
FIG. 10 illustrates the comparative hydrocarbon level in the exhaust of an engine with the same three injector nozzles as used in the tests represented in FIGS. 8 and 9.

FIG. 10 is a further series of graphs of hydrocarbon content (HC) in the exhaust gases of the engine, plotted against engine torque, with the three plots numbered 90B, 91B and 92B to indicate they are the HC figures obtained using the injection nozzles as represented by plots 90, 91 and 92 respectively in FIG. 8. It will be noted again that the two low penetration nozzles, as represented by plots 91B and 92B provide significant reduction in hydrocarbons in the exhaust gases as compared with the high penetration spray represented by plot 90B.

It is to be understood that the present invention may be applied to any form of fuel injection system wherein the fuel is entrained in air or another gas, particularly a combustion supporting gas, and is delivered into a combustion chamber through a nozzle.

In one particular fuel injection system a metered quantity of fuel is delivered into a body of air and the so formed air and fuel mixture is discharged through a nozzle, upon opening of the nozzle, by the pressure differential existing between the body of air and the gas charge in the engine combustion chamber. The body of air may be static or moving as the fuel is metered thereinto. The mode of metering the fuel may be of any suitable type including pressurised fuel supplies that issue for an adjustable time period into the air body, or individual measured quantities of fuel delivered by a pulse of air.

The degree of penetration of the fuel into the combustion chamber may be controlled by the configuration of the injector nozzle, such as the design of the poppet valve or port as above described and/or by the control of the pressure differential through the nozzle, and/or the degree of lift of the valve element controlling the flow through the nozzle.

Fuel injection systems and metering devices suitable for use in carrying the present invention into practice are disclosed in U.S. Pat. Nos. 4,462,760, 4,692,224 and 4,554,945 and U.S. patent application Ser. No. 849,501, filed Mar. 26, 1986 still pending.

In the present specification reference has been made to the use of the present invention in conjunction with an engine operating on the two-stroke cycle and with spark ignition, however it is to be understood that the invention is equally applicable to spark ignited engines operating on the four-stroke cycle. The invention is applicable to internal combustion engines for all uses but is particularly useful in contributing to fuel economy and control of exhaust emissions in engines for or in vehicles, including automobiles motor cycles and boats including outboard marine engines.

The claims defining the invention are as follows:

We claim:

1. A method of injecting fuel directly into a combustion chamber of an internal combustion engine comprising entraining a metered quantity of fuel in a gas, delivering the fuel-gas mixture so formed through a selectively openable nozzle into the combustion chamber under conditions that establish a fuel spray having a dispersion velocity in the direction of the spray axis of not more than 25 meters/sec at 35 millimeters of spray penetration from the nozzle when measured under atmospheric pressure in still air.

2. A method of injecting fuel as claimed in claim 1 wherein said spray dispersion velocity in the direction of the spray axis is less than 18 meters/sec at 70 millimeters of spray penetration under atmospheric pressure in still air.

3. A method of injecting fuel as claimed in claim 1 wherein said spray dispersion velocity at said 35 millimeters of penetration is less than 18 meters/sec.

4. A method of fuel injection as claimed in claim 1 wherein said spray dispersion velocity at said 35 millimeters of penetration is 6 to 10 meters/sec.

5. A method of fuel injection as claimed in claim 1, 2 or 3 wherein the spray dispersion velocity in the direction normal to the axis of the spray is less than 20 meters/sec at at a radial distance of 35 millimeters from said axis.

6. A method of fuel injection as claimed in any one of claims 1, 2 or 3 wherein the spray dispersion velocity in the direction normal to the axis of the spray is less than 10 meters/sec at 35 millimeters from said axis.

7. A method of fuel injection as claimed in any one of claims 1, 2 or 3 wherein the metered quantity of fuel is delivered into a chamber containing gas to entrain the fuel in said gas, and a port is selectively opened to communicate the chamber with the combustion chamber, said gas in the chamber being at a pressure to deliver the fuel-gas mixture into the combustion chamber when the port is open.

8. A method of injecting fuel as claimed in any one of claims 1, 2 or 3 including the step of promoting preferred respective paths for the fuel-gas mixture as it passes through the port to produce a first array of generally circular cross-section of gas entrained fuel droplets and a second array of gas entrained fuel droplets within the region defined by the first array issuing from the port.

9. A method as claimed in claim 8 wherein the first array of gas entrained fuel droplets diverge outwardly with respect of the axis of the array.

10. A method as claimed in any one of claims 1, 2 or 3 wherein the gas entrained fuel is injected to the combustion chamber through a port and selectively moving a valve element relative to the port to open and close the port, said port and valve element defining an annular passage when the port is open, said passage having a series of notches along at least part of at least one of the peripheral edges of said annular passage, said gas entrained fuel being propelled through passage and with part thereof passing through said notches, said notches being arranged to form an array of gas entrained fuel droplets issuing therethrough into the combustion chamber on a path different to that of the remainder of the gas entrained fuel droplets issuing from the annular passage.

11. A method of injecting fuel directly into a combustion chamber of a two stroke cycle spark ignited engine comprising entraining a metered quantity of fuel in a gas, delivering the fuel-gas mixture so formed through a nozzle into the combustion chamber under conditions that establish a fuel spray having a dispersion velocity in the direction of the spray axis of not more than 25 meters/sec at 35 millimeters of spray penetration from the nozzle when measured under atmospheric pressure in still air.

12. A method of injecting fuel as claimed in claim 1 or 11 wherein the combustion chamber is formed between a cylinder head and a piston that reciprocates in a cylinder, said cylinder head having a cavity therein open toward the piston, said method including the step of injecting the fuel-gas mixture into the combustion chamber through a wall of said cavity and in a direction toward the piston.

13. A method as claimed in claim 12 wherein said spray dispersion velocity in the direction of the spray axis is less than 18 meters/sec at 70 millimeters of spray penetration under atmosheric pressure in still air.

14. A method as claimed in claim 12 wherein said spray dispersion velocity at said 35 millimeters of penetration is 6 to 10 meters/sec.

15. A method as claimed in claim 12 wherein the metered quantity of fuel is delivered into a chamber containing gas to entrain the fuel in said gas, and a port is selectively opened to communicate the chamber with the combustion chamber, said gas in the chamber being at a pressure to deliver the fuel-gas mixture into the combustion chamber when the port is open.

16. A method as claimed in claim 12 including the step of promoting preferred respective paths for the fuel-gas mixture as it passes past the nozzle to produce a first array of generally circular cross-section of gas entrained fuel droplets and a second array of gas entrained fuel droplets within the region defined by the first array issuing from the port.

17. A method of injecting fuel into a combustion chamber of a spark ignited internal combustion engine wherein the combustion chamber is formed between a cylinder head and a piston that reciprocates in a cylinder, said cylinder head having a cavity therein open toward the piston including the steps of entraining a metered quantity of fuel in a gas and delivering said gas entrained fuel into the combustion chamber through a port, selectively opening said port to effect said delivery by moving a valve element relative to the port to open and close the port, said port and valve element defining an annular passage when the port is open, the gas entrained fuel being delivered through said passage under conditions that establish a fuel spray having a dispersion velocity in the direction of the spray axis of not more than 25 meters/sec at 35 millimeters of spray penetration from the nozzle when measured under atmospheric pressure in still air.

18. A method of injecting fuel as claimed in claim 17 wherein said passage has a series of notches along at least part of at least one of the peripheral edges of said annular passage, said gas entrained fuel being propelled through said passage with part thereof passing through said notches, said notches being arranged to form an array of gas entrained fuel droplets issuing therethrough into the combustion chamber on a path different to that of the remainder of the gas entrained fuel droplets issuing from the annular passage.

19. A method of injecting fuel into a combustion chamber of an internal combustion engine comprising delivering a metered quantity of fuel through a selectively openable nozzle into the combustion chamber under conditions that establish a fuel spray having a dispersion velocity in the direction of the spray axis of not more than 25 meters/sec at 35 millimeters of spray penetration from the nozzle when measured under atmospheric pressure in still air.

20. A method of injecting fuel as claimed in claim 19 wherein said spray dispersion velocity in the direction of the spray axis is less than 18 meters/sec at 70 millimeters of spray penetration under atmospheric pressure in still air.

21. A method of injecting fuel as claimed in claim 19 wherein said spray dispersion velocity at said 35 millimeters of penetration is less than 18 meters/sec.

22. A method of fuel injection as claimed in claim 19, 20 or 21 wherein the spray dispersion velocity in the direction normal to the axis of the spray is less than 20 meters/sec at a radial distance of 35 millimeters from said axis.

23. A fuel injector for injecting fuel directly into a combustion chamber of an internal combustion engine comprising metering means for providing a metered quantity of fuel, entraining means for entraining the metered quantity of fuel in a gas, selectively openable nozzle means for establishing communication of the entrained fuel-gas mixture with said combustion chamber to deliver the fuel into the combustion chamber in the form of a fuel spray having an axis and having a dispersion velocity in the direction of the spray axis of not more than 25 meters/sec at 35 millimeters of spray penetration from the nozzle when measured under atmospheric pressure in still air.

24. An automobile internal combustion engine including a fuel injector of claim 23.

25. A road transport vehicle having an internal combustion engine which includes a fuel injector of claim 23.

26. An outboard marine internal combustion engine including a fuel injector of claim 23.

* * * * *